US009083100B2

(12) United States Patent
Uno et al.

(10) Patent No.: US 9,083,100 B2
(45) Date of Patent: Jul. 14, 2015

(54) CONNECTION TERMINAL AND METHOD FOR MANUFACTURING CONNECTION TERMINAL

(71) Applicant: YAZAKI CORPORATION, Minato-ku, Tokyo (JP)

(72) Inventors: Ryosuke Uno, Makinohara (JP); Shinji Kodama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 12 days.

(21) Appl. No.: 14/094,033

(22) Filed: Dec. 2, 2013

(65) Prior Publication Data

US 2014/0087597 A1 Mar. 27, 2014

Related U.S. Application Data

(63) Continuation of application No. PCT/JP2012/064139, filed on May 31, 2012.

(30) Foreign Application Priority Data

Jun. 3, 2011 (JP) ..... 2011-125196

(51) Int. Cl.

| | |
|---|---|
| ***H01R 13/40*** | (2006.01) |
| ***H01R 4/70*** | (2006.01) |
| ***H01R 43/16*** | (2006.01) |
| ***H01R 43/24*** | (2006.01) |
| ***H01R 43/00*** | (2006.01) |

(Continued)

(52) U.S. Cl.

CPC ..... *H01R 13/40* (2013.01); *H01R 4/70* (2013.01); *H01R 43/005* (2013.01); *H01R 43/16* (2013.01); *H01R 43/24* (2013.01); *H01R 4/185* (2013.01); *H01R 4/62* (2013.01); *Y10T 29/49176* (2015.01)

(58) Field of Classification Search

CPC ..... H01R 13/40; H01R 43/005; H01R 43/24; H01R 4/70; H01R 4/185; Y10T 29/49176

See application file for complete search history.

(56) References Cited

U.S. PATENT DOCUMENTS

| | | | | |
|---|---|---|---|---|
| 7,775,842 | B2 * | 8/2010 | Yamagami | 439/877 |
| 7,905,755 | B1 * | 3/2011 | Martauz | 439/877 |
| 8,181,343 | B2 * | 5/2012 | Martauz et al. | 29/863 |

(Continued)

FOREIGN PATENT DOCUMENTS

| | | | |
|---|---|---|---|
| JP | 10-289745 | A | 10/1998 |
| JP | 2001-167640 | A | 6/2001 |

(Continued)

OTHER PUBLICATIONS

Communication dated Feb. 3, 2015 from the Japanese Patent Office in counterpart application No. 2011-125196.

(Continued)

*Primary Examiner* — Ross Gushi
(74) *Attorney, Agent, or Firm* — Sughrue Mion, PLLC

(57) ABSTRACT

A connection terminal includes a terminal connection portion to be connected with a partner terminal, a wire connection portion connected with a wire, a neck portion connecting the terminal connection portion and the wire connection portion, and a resin covering portion covering a connection portion of the wire connection portion and the wire. The neck portion has a bottom wall and a pair of side walls installed upright from both sides of the bottom wall and having parallel wall portions equally spaced from each other.

7 Claims, 12 Drawing Sheets

(51) Int. Cl.

| | |
|---|---|
| *H01R 4/18* | (2006.01) |
| *H01R 4/62* | (2006.01) |

(56) References Cited

U.S. PATENT DOCUMENTS

| | | | | |
|---|---|---|---|---|
| 8,317,553 | B2 * | 11/2012 | Nishide | 439/884 |
| 8,360,803 | B2 * | 1/2013 | Sakai | 439/523 |
| 8,607,449 | B2 * | 12/2013 | Kitagawa et al. | 29/863 |
| 8,723,040 | B2 * | 5/2014 | Sakura | 174/74 R |
| 8,771,015 | B2 * | 7/2014 | Inoue et al. | 439/604 |
| 8,864,533 | B2 * | 10/2014 | Morikawa | 439/730 |
| 8,870,611 | B2 * | 10/2014 | Sato et al. | 439/877 |
| 8,900,010 | B2 * | 12/2014 | Aoki et al. | 439/587 |
| 8,927,863 | B2 * | 1/2015 | Tanikawa et al. | 174/74 R |
| 8,951,063 | B2 * | 2/2015 | Iio | 439/523 |
| 2001/0003688 | A1 * | 6/2001 | Kondo | 439/604 |
| 2002/0127915 | A1 | 9/2002 | Kondo | |
| 2004/0063360 | A1 * | 4/2004 | Kikuchi | 439/736 |
| 2011/0070770 | A1 * | 3/2011 | Sakai | 439/521 |
| 2013/0052887 | A1 * | 2/2013 | Inoue et al. | 439/877 |
| 2013/0098679 | A1 * | 4/2013 | Takata et al. | 174/74 R |
| 2013/0126234 | A1 * | 5/2013 | Ono et al. | 174/75 R |
| 2013/0199842 | A1 * | 8/2013 | Inoue et al. | 174/84 |
| 2013/0210255 | A1 * | 8/2013 | Uchiyama et al. | 439/271 |
| 2013/0213709 | A1 * | 8/2013 | Kawamura et al. | 174/72 A |
| 2013/0225014 | A1 * | 8/2013 | Sato et al. | 439/736 |
| 2013/0231013 | A1 * | 9/2013 | Sato et al. | 439/878 |
| 2013/0252481 | A1 * | 9/2013 | Sato et al. | 439/736 |
| 2013/0292173 | A1 * | 11/2013 | Inoue et al. | 174/74 R |
| 2013/0344752 | A1 * | 12/2013 | Takayama et al. | 439/877 |
| 2014/0011411 | A1 * | 1/2014 | Matsushita | 439/877 |
| 2014/0030901 | A1 * | 1/2014 | Xu et al. | 439/271 |
| 2014/0059853 | A1 * | 3/2014 | Steinberg et al. | 29/855 |
| 2014/0087597 | A1 * | 3/2014 | Uno et al. | 439/736 |
| 2014/0106625 | A1 * | 4/2014 | Kato et al. | 439/736 |
| 2014/0106629 | A1 * | 4/2014 | Matsushita | 439/877 |
| 2014/0165393 | A1 * | 6/2014 | Sato | 29/858 |
| 2014/0194002 | A1 * | 7/2014 | Sato | 439/589 |
| 2014/0194003 | A1 * | 7/2014 | Nabeta | 439/604 |
| 2014/0242852 | A1 * | 8/2014 | Matsui | 439/730 |
| 2014/0311799 | A1 * | 10/2014 | Kawamura et al. | 174/75 R |
| 2014/0318862 | A1 * | 10/2014 | Tachi et al. | 174/75 R |
| 2014/0335741 | A1 * | 11/2014 | Uno | 439/736 |
| 2014/0349501 | A1 * | 11/2014 | Aizawa et al. | 439/190 |
| 2014/0370763 | A1 * | 12/2014 | Bechstein | 439/887 |
| 2015/0011116 | A1 * | 1/2015 | Ohnuma | 439/519 |
| 2015/0011117 | A1 * | 1/2015 | Ohnuma | 439/520 |
| 2015/0021090 | A1 * | 1/2015 | Mano et al. | 174/72 A |

FOREIGN PATENT DOCUMENTS

| | | | |
|---|---|---|---|
| JP | 2010-097704 | A | 4/2010 |
| JP | 2010-108798 | A | 5/2010 |
| JP | 2010108828 | A | 5/2010 |
| JP | 2010-135121 | A | 6/2010 |
| JP | 2010-165630 | A | 7/2010 |
| JP | 2012204239 | A | 10/2012 |

OTHER PUBLICATIONS

Communication dated Feb. 18, 2015 from the Russian Patent Office in counterpart application No. 2013157830/090096).

Communication dated Apr. 14, 2015, issued by the Japan Patent Office in corresponding application No. 2011-125196.

Communication date May 5, 2015 from the State Intellectual Property Office of People's Republic of China in counterpart Application No. 201280027273.4.

* cited by examiner

CONNECTION TERMINAL AND METHOD FOR MANUFACTURING CONNECTION TERMINAL

CROSS REFERENCE TO RELATED APPLICATION

This application is a Continuation of PCT Application No. PCT/JP2012/064139, filed on May 31, 2012, and claims the priority of Japanese Patent Application No. 2011-125196, filed on Jun. 3, 2011, the content of both of which is incorporated herein by reference.

BACKGROUND

1. Technical Field

The present invention relates to a connection terminal in which a connection portion of a wire connection portion and a wire is covered with a resin covering portion and a method of manufacturing the connection terminal.

2. Related Art

Japanese Unexamined Patent Application Publication No. 2010-97704 and Japanese Unexamined Patent Application Publication No. 2010-135121 propose connection terminals in which a connection portion of a wire connection portion and a wire is covered with a resin covering portion. An example of such a connection terminal is shown in FIGS. 1 to 4B.

As shown in FIGS. 1 and 2, a connection terminal 100 includes a terminal connection portion 101 to which a partner terminal is to be connected, a wire connection portion 110 to which a wire W is connected, and a neck portion 120 connecting the terminal connection portion 101 and the wire connection portion 110. The terminal connection portion 101, the wire connection portion 110, and the neck portion 120 are formed by bending one sheet of conductive metal plate.

The terminal connection portion 101 has a rectangular cylindrical shape. A partner terminal is inserted into the cylindrical shape. The wire connection portion 110 has a U-shaped surrounding wall 111. A pair of first wire caulking portions 113 and a second wire caulking portion 114 are projected from an upper end surface of both side ends of the surrounding wall 111. A core wire 150 of the wire W is crimped by the pair of first wire caulking portions 113 through caulking and a portion of the wire W covered with a covering skin 151 is crimped by the second wire caulking portion 114 through caulking.

The neck portion 120 has a bottom wall 121 and a pair of side walls 122 installed upright from both side ends of the bottom wall 121. The bottom wall 121 and the pair of side walls 122 are formed continuously from each wall of the terminal connection portion 101 and the wire connection portion 110. The pair of side walls 122 are inclined so as to gradually make the interval therebetween narrower from the terminal connection portion 101 toward the wire connection portion 110. The width dimension of the terminal connection portion 101 is narrowed to the width dimension of the wire connection portion 110 by the neck portion 120.

The connection portion of the wire connection portion 110 and the wire W is covered with a resin covering portion 130. The resin covering portion 130 is produced by injection molding of resin.

That is, as shown in FIG. 3, the connection terminal 100 to which the wire W is connected is set to a die 140 for resin molding. The die 140 includes a lower die 141 and an upper die (not shown). FIG. 3 shows a state in which the connection terminal 100 is set to the lower die 141. Next, a resin is poured into a cavity 141*a* inside the lower die 141 and the upper die (not shown) and the resin covering portion 130 is produced by the poured resin being set.

A resin blocking piece 142 (shown as a virtual line in FIG. 2) of the die 140 enters the neck portion 120 during resin molding. Both side surfaces of the resin blocking piece 142 are formed as inclined planes corresponding to the pair of side walls 122. The resin blocking piece 142 blocks molten resin to prevent the molten resin from flowing from the wire connection portion 110 toward the terminal connection portion 101.

According to an above related example, when, for example, the connection terminal 100 and the core wire 150 of the wire W are made of different metallic materials (for example, the connection terminal 100 made of copper and the wire W made of aluminum), if water or the like enters the connection portion of both, a current flows due to a potential difference therebetween and corrosion is caused and so such corrosion is prevented by the resin covering portion 130.

SUMMARY

However, in the connection terminal 100 of the aforementioned example, the pair of side walls 122 of the neck portion 120 are inclined and thus, if, as shown in FIG. 4A, the resin blocking piece 142 is set to a position shifted to the side of the terminal connection portion 101 from a predetermined position of the neck portion 120, a gap d is formed between the resin blocking piece 142 and each of the side walls 122 and molten resin cannot be reliably be blocked. If, as shown in FIG. 4B, the resin blocking piece 142 is set to a position shifted to the side of the wire connection portion 110 from the predetermined position of the neck portion 120, the resin blocking piece 142 hits the upper end surface of each of the side walls 122 so that the resin blocking piece 142 cannot be set. In addition, the resin blocking piece 142 or the side walls 122 may be damaged white attempting to set. Therefore, it is necessary to position and manage the resin blocking piece 142 with high precision and positioning and managing the resin blocking piece 142 takes a lot of time and effort An object of the present invention is to provide a connection terminal in which a resin blocking piece can easily be positioned and managed and a method of manufacturing the connection terminal.

A connection terminal in accordance with some embodiments including: a terminal connection portion to be connected with a partner terminal; a wire connection portion connected with a wire; a neck portion connecting the terminal connection portion and the wire connection portion and having a bottom wall and a pair of side walls installed upright from both sides of the bottom wall, the pair of side walls having parallel wall portions equally spaced from each other; and a resin covering portion covering a connection portion of the wire connection portion and the wire.

A length of the parallel wall portions may be larger than a width of a resin blocking piece of a die for molding the resin covering portion.

A method of manufacturing a connection terminal in accordance with some embodiments including: producing a terminal connection portion to be connected with a partner terminal, a wire connection portion connected with a wire, and a neck portion connecting the terminal connection portion and the wire connection portion and having a bottom wall and a pair of side walls installed upright from both sides of the bottom wall; connecting the wire connection portion and the wire such that the pair of side walls of the neck portion have parallel wall portions equally spaced from each other; and molding a resin covering portion by covering a connection portion of the wire connection portion and the wire with a die.

When the resin covering portion is molded, the wire and the neck portion may be each held in proper positions by holding portions of the die.

When the wire connection portion and the wire are connected, the parallel wall portions of the neck portion may be corrected to a proper position by a neck portion correction portion of the die.

A length of the parallel wall portions may be formed larger than a width of a resin blocking piece of the die.

According to an embodiment of the present invention, a necking portion has a pair of parallel wall portions equally spaced from each other and thus, if a resin blocking piece is arranged within the range of the pair of parallel wall portions, the resin blocking piece is properly set. Therefore, positioning and managing the resin blocking piece is made easier.

DETAILED DESCRIPTION

Figure 1:
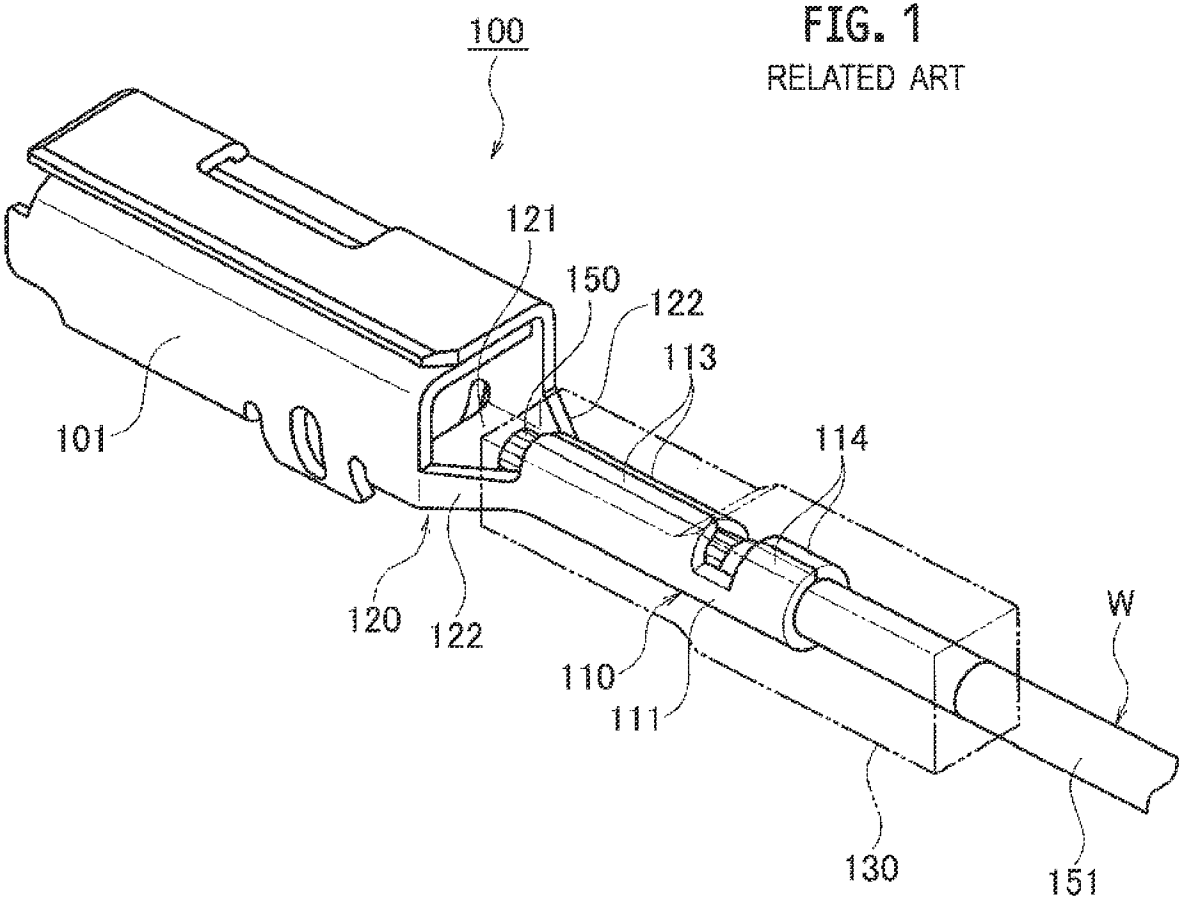
FIG. 1 RELATED ART
FIG. 1 is a perspective view of a related connection terminal.
Figure 2:
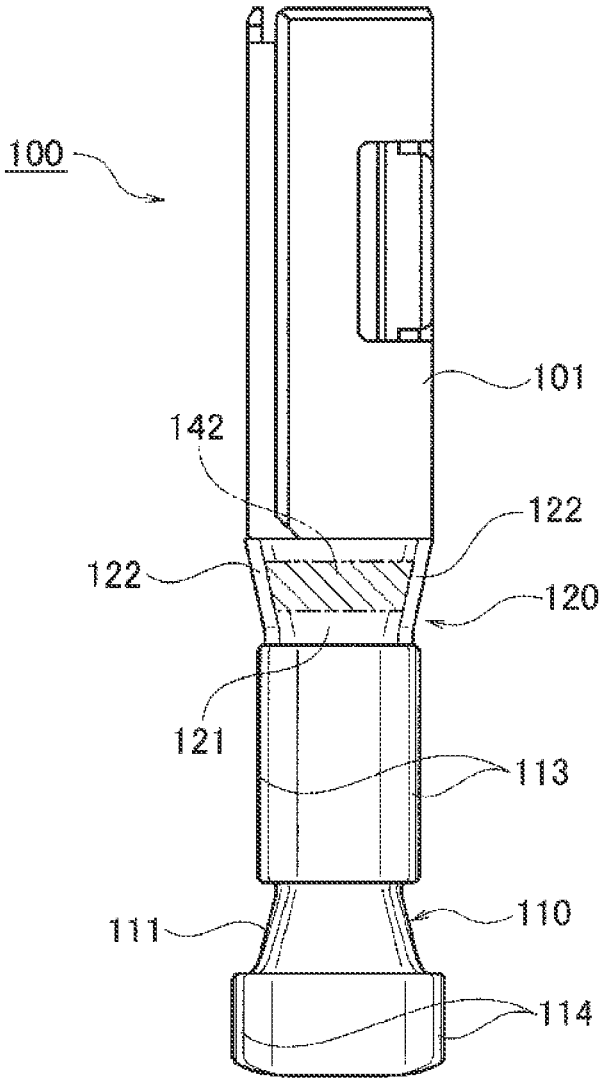
FIG. 2 RELATED ART
FIG. 2 is a plan view of a main body of the connection terminal in FIG. 1 before wire connection.
Figure 3:
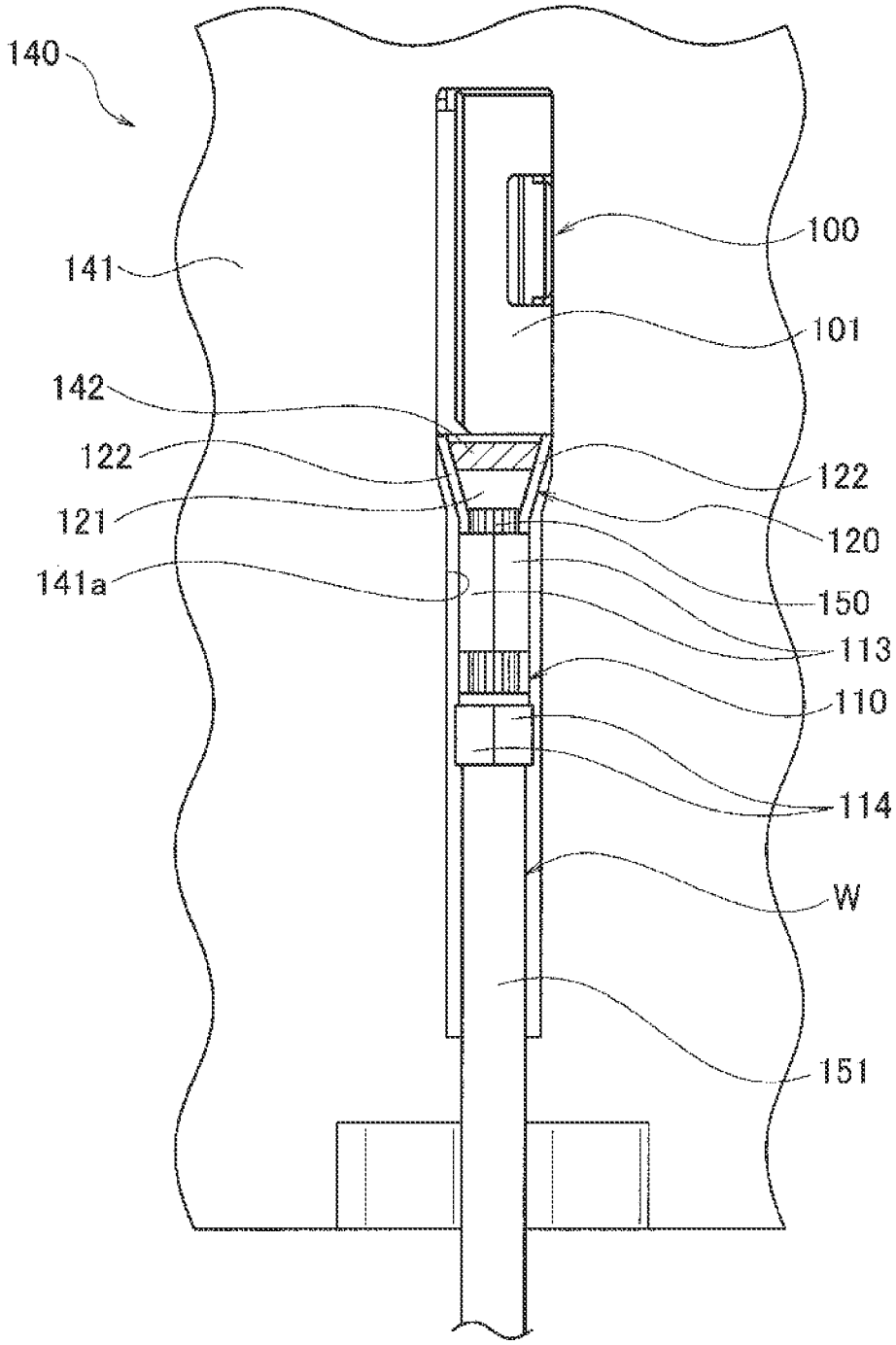
FIG. 3 RELATED ART
FIG. 3 is a plan view showing a state in which the connection terminal in FIG. 1 is set to a lower die for resin molding.
Figure 4A:
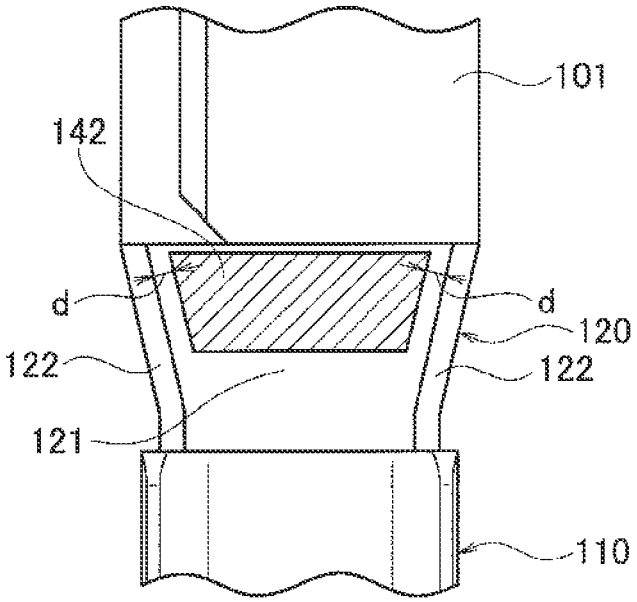
FIG. 4A RELATED ART
FIG. 4A is a plan view of the connection terminal in FIG. 1 showing a case when a resin blocking piece is shifted to the side of a terminal connection portion.
Figure 4B:
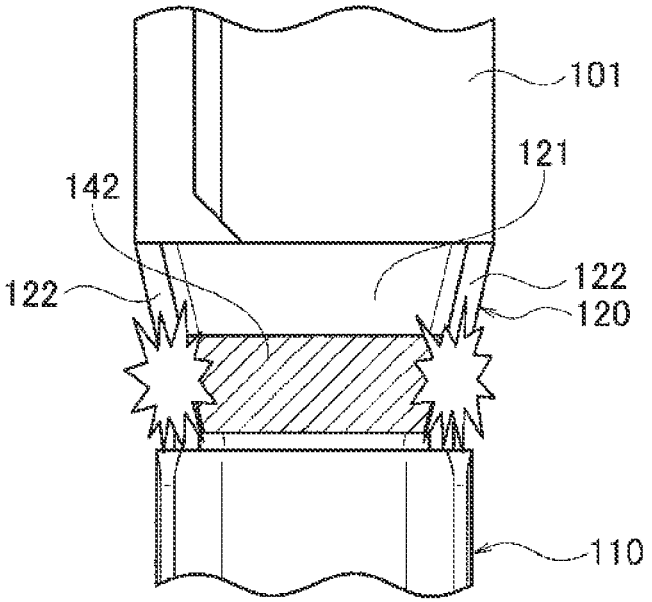
FIG. 4B RELATED ART
FIG. 4B is a plan view of the connection terminal in FIG. 1 showing a case when the resin blocking piece is shifted to the side of a wire connection portion.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An embodiment of the present invention will be described below based on the drawings.

Figure 5:
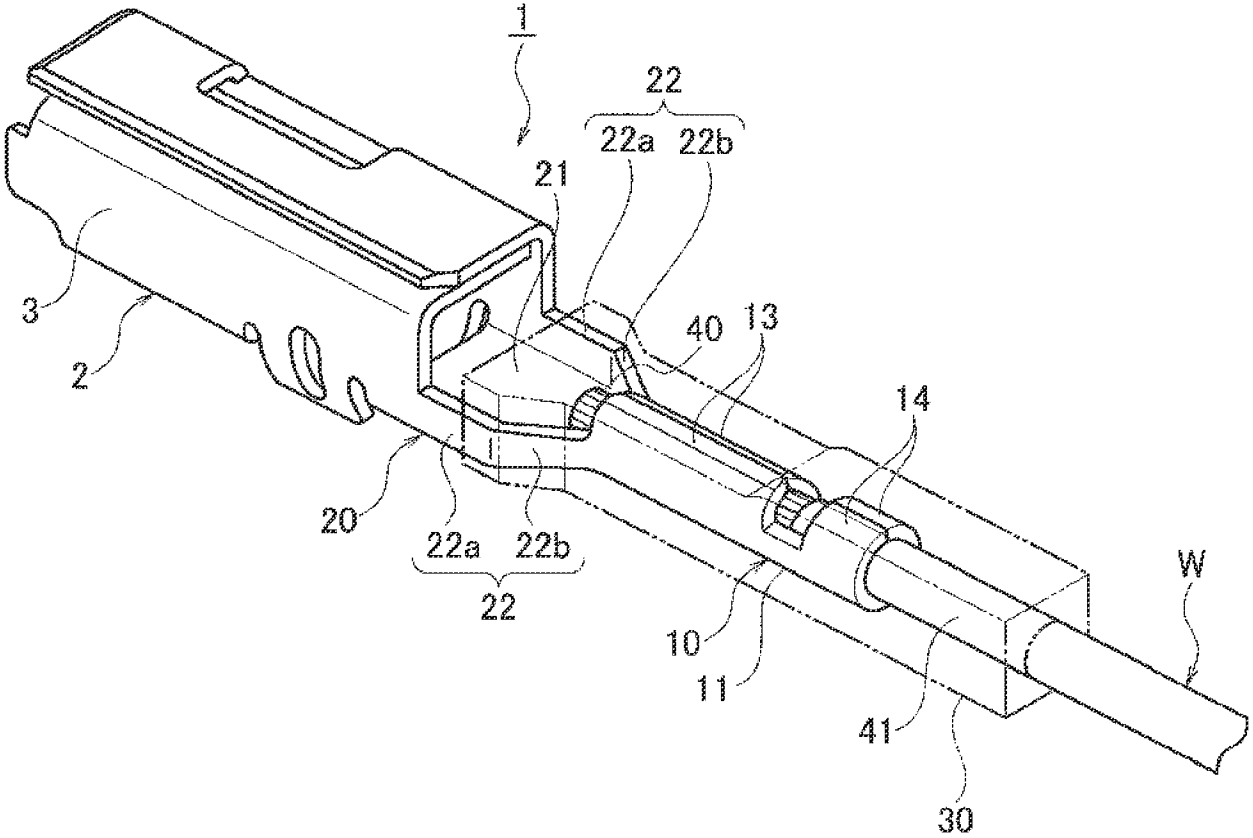
FIG. 5 is a perspective view of a connection terminal according to an embodiment of the present invention.

FIGS. 5 to 14 show an embodiment of the present invention. As shown in FIGS. 5, 6A, and 6B, a connection terminal 1 includes a terminal connection portion 2 to which a partner terminal (not shown) is to be connected, a wire connection portion 10 to which the wire W is connected, and a neck portion 20 connecting the terminal connection portion 2 and the wire connection portion 10. The terminal connection portion 2, the wire connection portion 10, and the neck portion 20 are formed by bending a plate made of copper alloy as one sheet of conductive metal plate.

The terminal connection portion 2 has a rectangular cylindrical portion 3 and an elastic contact piece 4 (shown in FIG. 7A) arranged inside the cylindrical portion 3. When a partner terminal is inserted into the cylindrical portion 3, the partner terminal is brought into close contact due to a deflection restoring force of the elastic contact piece 4 and electrically connected.

The wire connection portion 10 has a U-shaped surrounding wall 11. A pair of first wire caulking portions 13 and a pair of second wire caulking portions 14 are projected from an upper end surface of both side ends of the surrounding wall 11. An exposed core wire 40 of the wire W is crimped by the pair of first wire caulking portions 13 through caulking. A portion of the wire W covered with an insulating skin 41 is crimped by the pair of second wire caulking portions 14 through caulking. The core wire 40 of the wire W is made of an aluminum material.

The neck portion 20 has a bottom wall 21 and a pair of side walls 22 installed upright from both side ends of the bottom wall 21. The bottom wall 21 and the pair of side walls 22 are formed continuously from each wall of the terminal connection portion 2 and the wire connection portion 10.

Figure 6A:
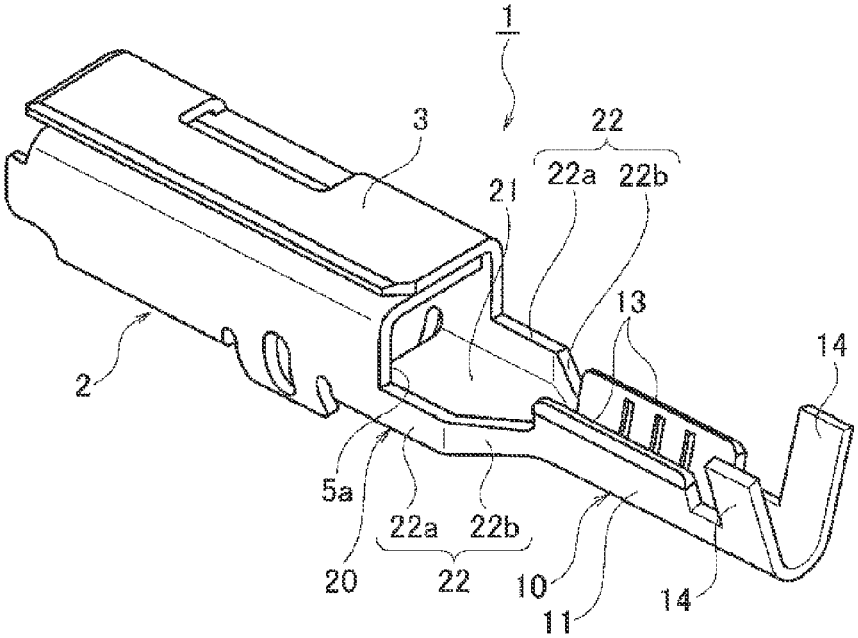
FIG. 6A shows the connection terminal according to an embodiment of the present invention and is a perspective view of the main body of the connection terminal before wire connection
Figure 6B:
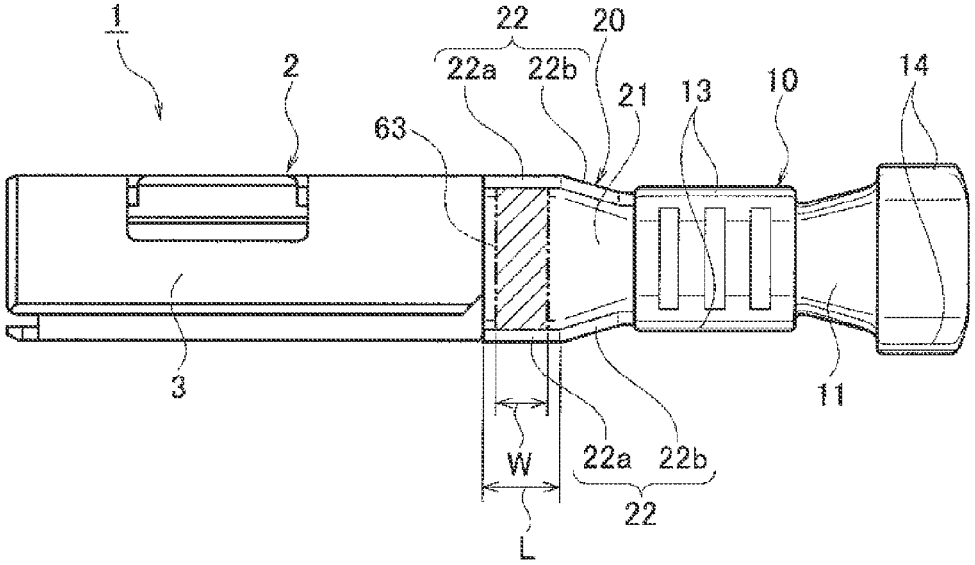
FIG. 6B shows the connection terminal according to an embodiment of the present invention and is a plan view of the main body of the connection terminal before wire connection.
Figure 14:
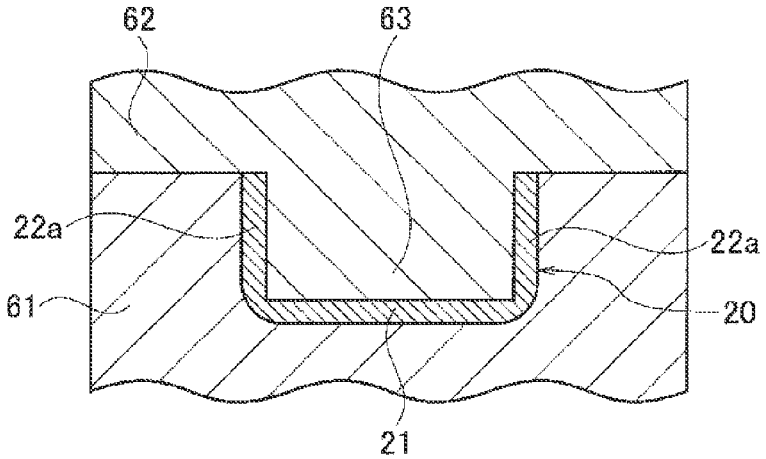
FIG. 14 is a sectional view along an XIV-XIV line in FIG. 13.

The pair of side walls 22 includes parallel wall portions 22*a* equally spaced from each other and inclined wall portions 22*b* where the interval therebetween changes. As shown in FIGS. 6B and 14, a length dimension L of each of the parallel wall portions 22*a* (dimension in the axial direction of the connection terminal 1) is set larger than a width W of a resin blocking piece 63 of a die 60 for resin molding (dimension of the resin blocking piece 63 in the axial direction of the connection terminal 1) described below. A pair of the inclined wall portions 22*b* are inclined in directions that gradually make the interval therebetween narrower from the terminal connection portion 2 toward the wire connection portion 10. The width direction of the terminal connection portion 2 is narrowed up to the width dimension of the wire connection portion 10 by the pair of inclined wall portions 22*b*.

The connection portion of the wire connection portion 10 and the wire W is covered with a resin covering portion 30. The resin covering portion 30 completely covers an outer circumference of the wire connection portion 10 and an end portion of the wire W. Corrosion caused by infiltration of water or the like into the connection portion of the wire connection portion 10 and the wire W can be prevented by the resin covering portion 30. The resin covering portion 30 is produced by, as will be described below, resin injection molding by the die 60.

Figure 7A:
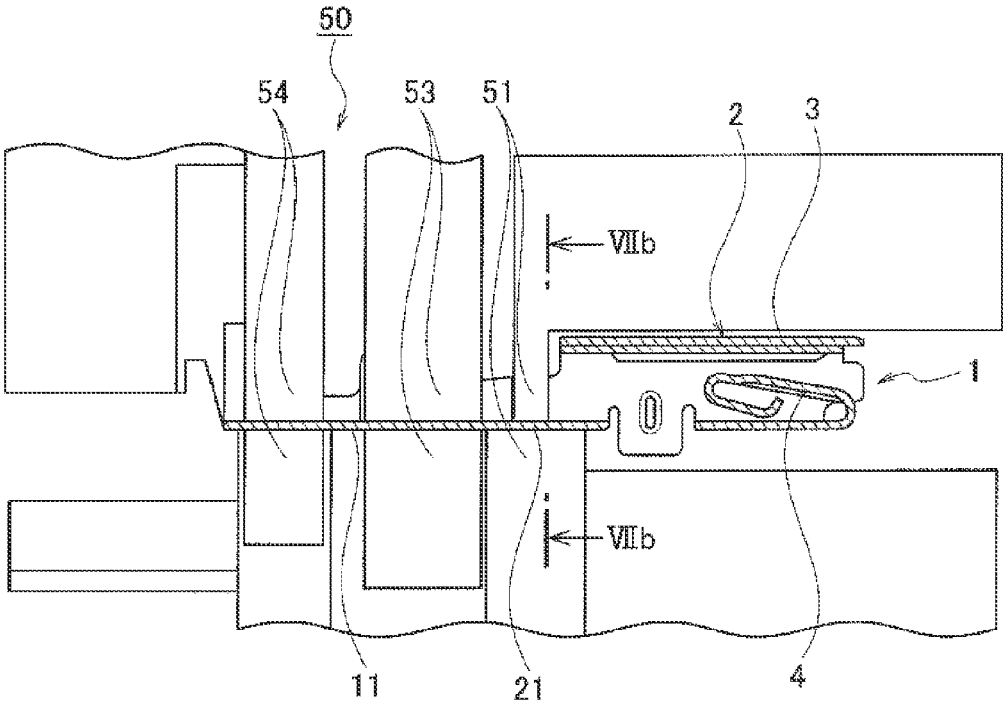
FIG. 7A shows the connection terminal according to an embodiment of the present invention and is a side view showing a state in which the connection terminal is set to a wire application device
Figure 7B:
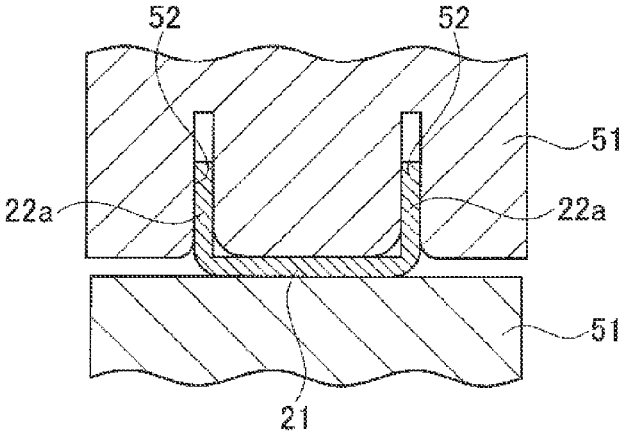
FIG. 7B is a sectional view along a VIIb-VIIb line in FIG. 7A.

Next, the procedure for producing the connection terminal 1 will be described. First, the connection terminal 1 shown in FIGS. 6A and 6B is produced by press molding of a metallic plate or the like. Next, a wire connection process to connect the wire connection portion 10 and the end portion of the wire W is performed. That is, in the wire connection process, as shown in FIG. 7A, the connection terminal 1 and the end portion of the wire Ware set to a wire application device 50. The wire application device 50 has a neck portion correction portion 51. The neck portion correction portion 51 has, as shown in FIG. 7B, a pair of slits 52 extending in the vertical direction. A pair of the parallel wall portions 22*a* of the neck portion 20 are inserted into the pair of slits 52. Then, the wire W is crimped by the first wire caulking portions 13 and the second wire caulking portions 14 being caulked into a predetermined shape by a first caulking portion 53 and a second caulking portion 54 of the wire application device 50. The pair of parallel side walls 22*a* of the neck portion 20 holds the vertical state by the neck portion correction portion 51 without being deformed under the influence of a bending force during caulking.

Figure 13:
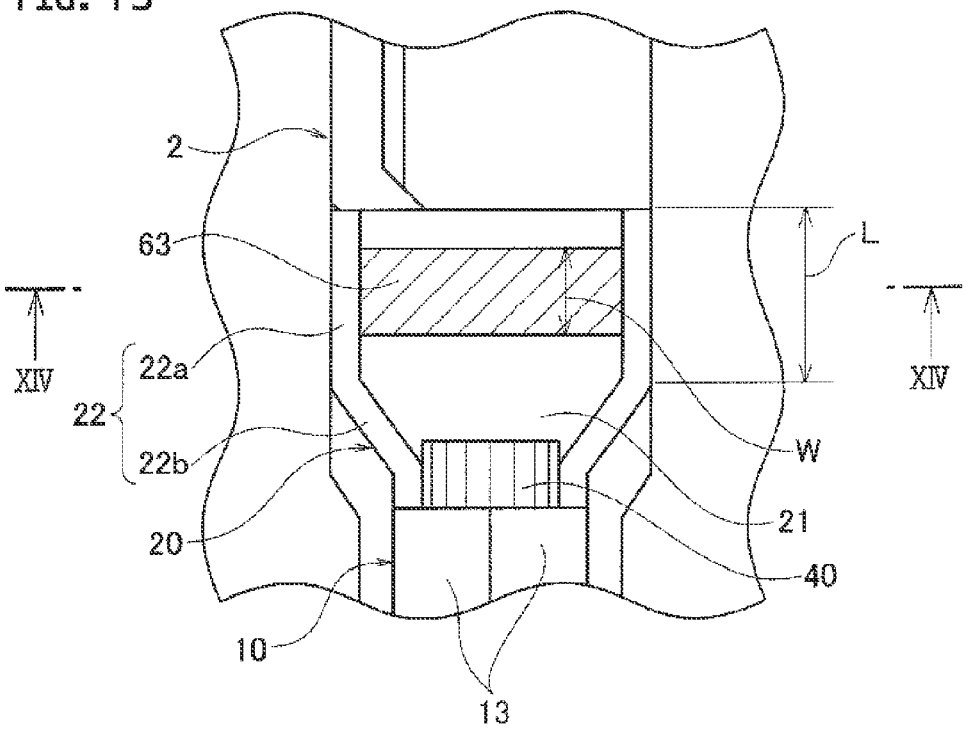
FIG. 13 is a sectional view along an XIII-XIII line in FIG. 12.

Next, a resin molding process by the die 60 is performed. First, the configuration of the die 60 will be described. The die 60 includes a lower die 61 and an upper die 62. The upper die 62 is provided with the resin blocking piece 63 in a position corresponding to the pair of parallel wall portions 22*a* of the neck portion 20. The resin blocking piece 63 is set to such a dimension allowing to be inserted between the pair of parallel wall portions 22*a* without any gap. In contrast to the related example, both side surfaces of the resin blocking piece 63 are set as surfaces parallel to each other to correspond to the pair of parallel wall portions 22*a*. As shown in FIG. 13, corners of an insertion tip of the resin blocking piece 63 correspond to a rectangular shape of the inner surface of the neck portion 20 and are set to a right-angled shape, instead of an R shape. Accordingly, no gap is formed also at a corner.

Figure 11:
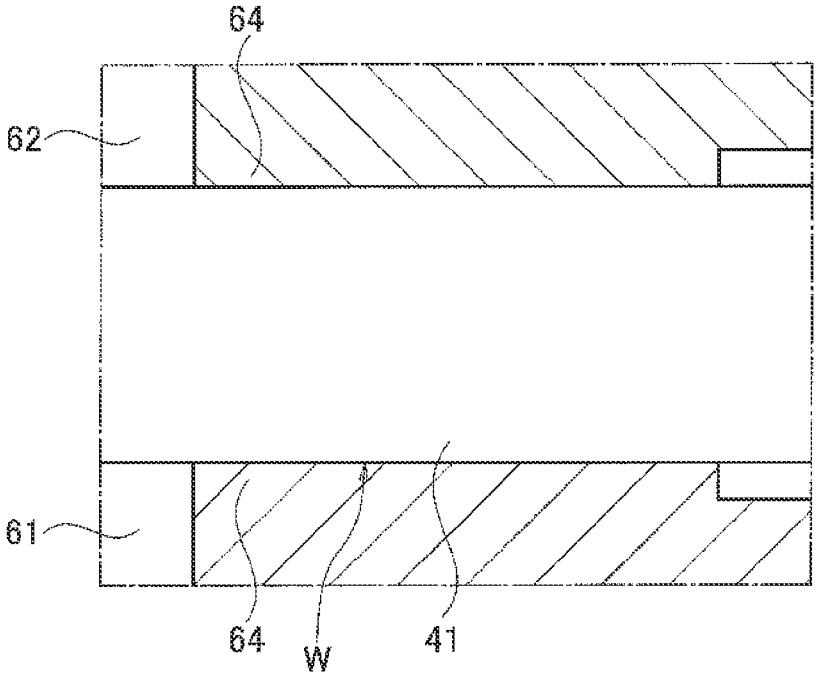
FIG. 11 is an enlarged view of a C portion in FIG. 10.
Figure 12:
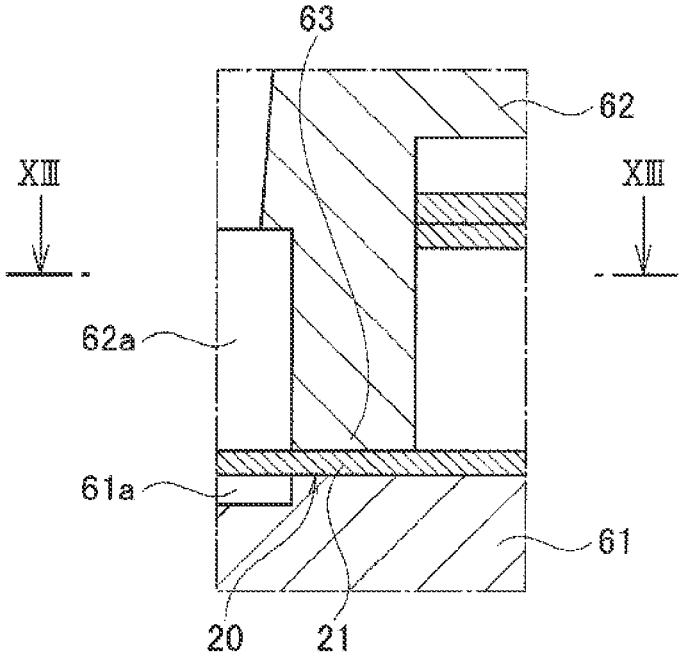
FIG. 12 is an enlarged view of a D portion in FIG. 10.

The resin blocking piece 63 also serves as a terminal holding portion that holds the connection terminal 1 in a proper position by pressing against the bottom wall 21 of the neck portion 20. The die 60 sandwiches the wire W in an up and down direction and has a wire holding portion 64 that holds the wire W in a proper position. That is, the die 60 holds, as shown in FIG. 11, the wire W in a proper position by the wire holding portion 64 and holds, as shown in FIG. 12, the connection terminal 1 in a proper position by the resin blocking piece 63. Using the die 60 configured as described above, resin molding is performed.

Figure 8:
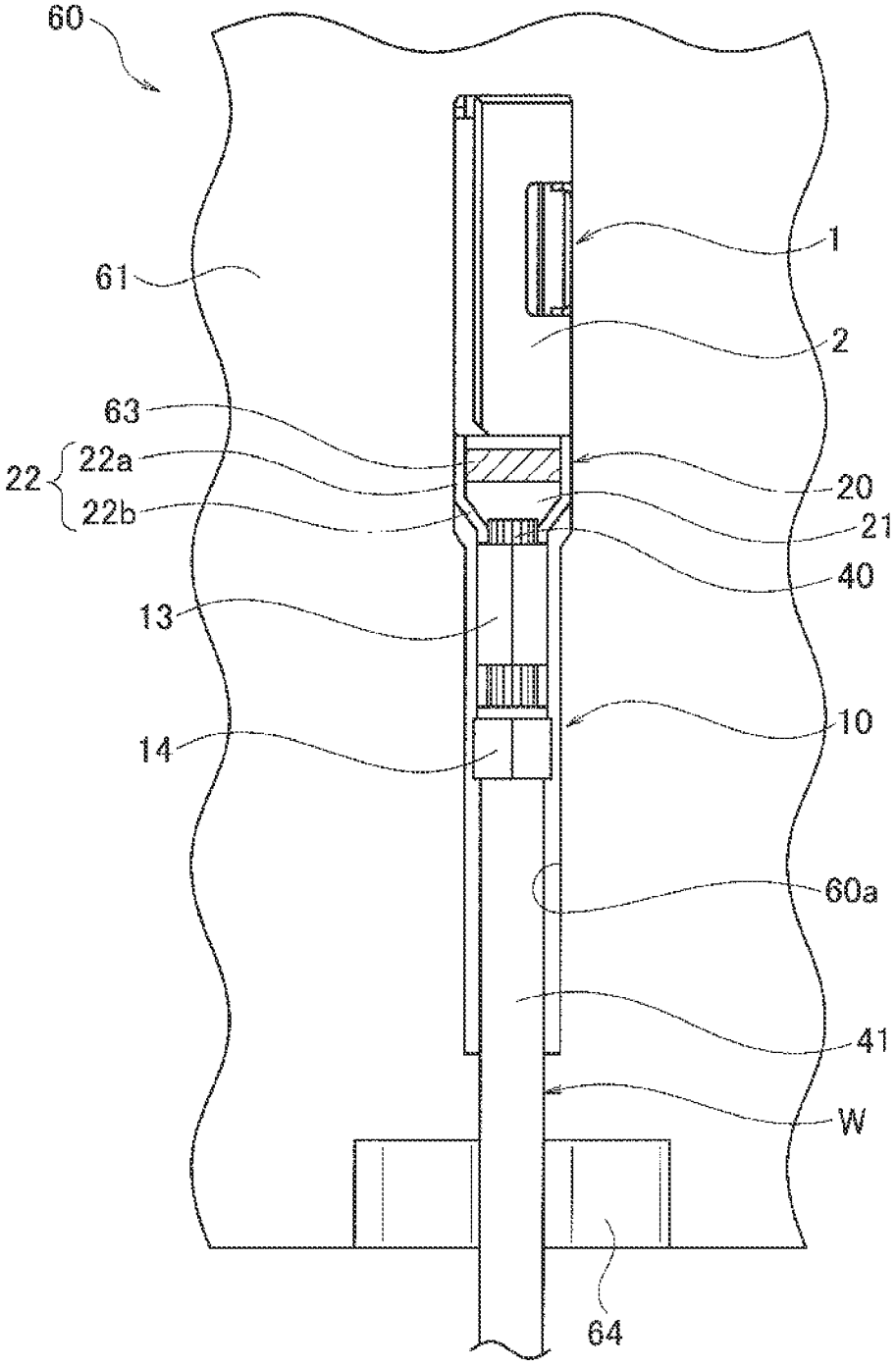
FIG. 8 is a plan view showing a state in which the connection terminal according to an embodiment of the present invention is set to the lower die for resin molding.
Figure 9:
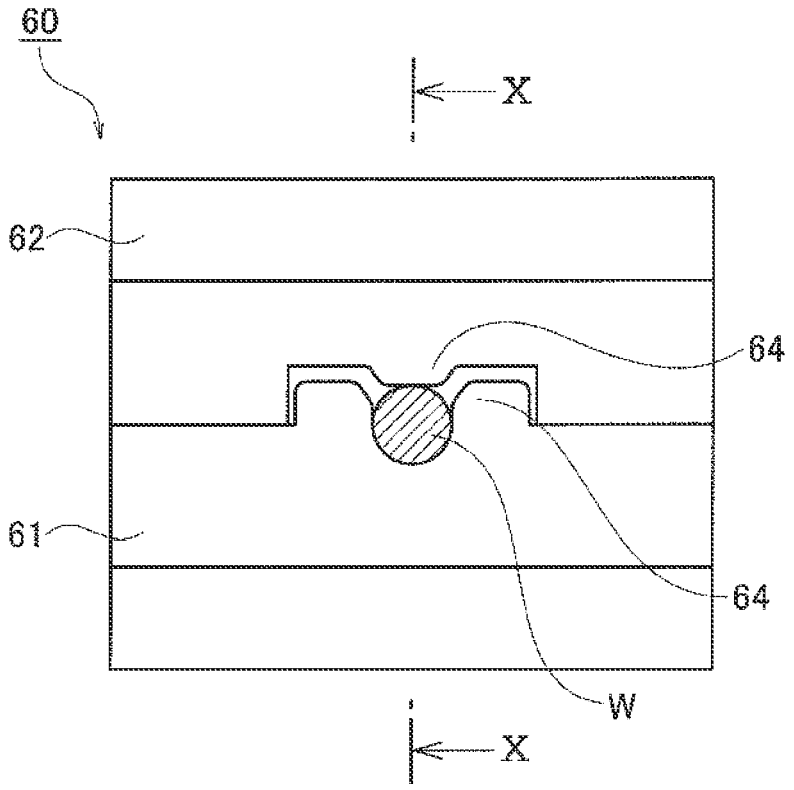
FIG. 9 is a side view showing a state in which the connection terminal according to an embodiment of the present invention is set to a die for resin molding.

In the resin molding process, as shown in FIG. 8, the connection terminal 1 to which the wire W is connected is set to the die 60 for resin molding (in FIG. 8, a state set to the lower die 61 is shown). Next, a resin is poured into cavities 61*a*, 61*b* inside the die 60 and the resin covering portion 30 is produced by the poured resin being set.

As shown in FIGS. 13 and 14, the resin blocking piece 63 of the die 60 is inserted into the neck portion 20 for resin molding. The neck portion 20 has the pair of parallel wall portions 22*a* equally spaced from each other and thus, if the resin blocking piece 63 is arranged within the range of the pair of parallel wall portions 22*a*, the resin blocking piece 63 is properly set. That is, the resin blocking piece 63 is properly set inside the pair of parallel wall portions 22*a* without any gap without, like the related example, a gap being formed between the resin blocking piece 63 and the inner surface of the pair of side walls 22 or each of the side walls 22 being hit by the resin blocking piece 63. Therefore, the resin blocking piece 63 can easily be positioned and managed.

The length dimension L of the parallel wall portion 22*a* is set larger than the width W of the resin blocking piece 63 of the die 60 for resin molding. Therefore, the resin blocking piece 63 can easily and reliably be set to within the range of the pair of parallel wall portions 22*a*.

Figure 10:
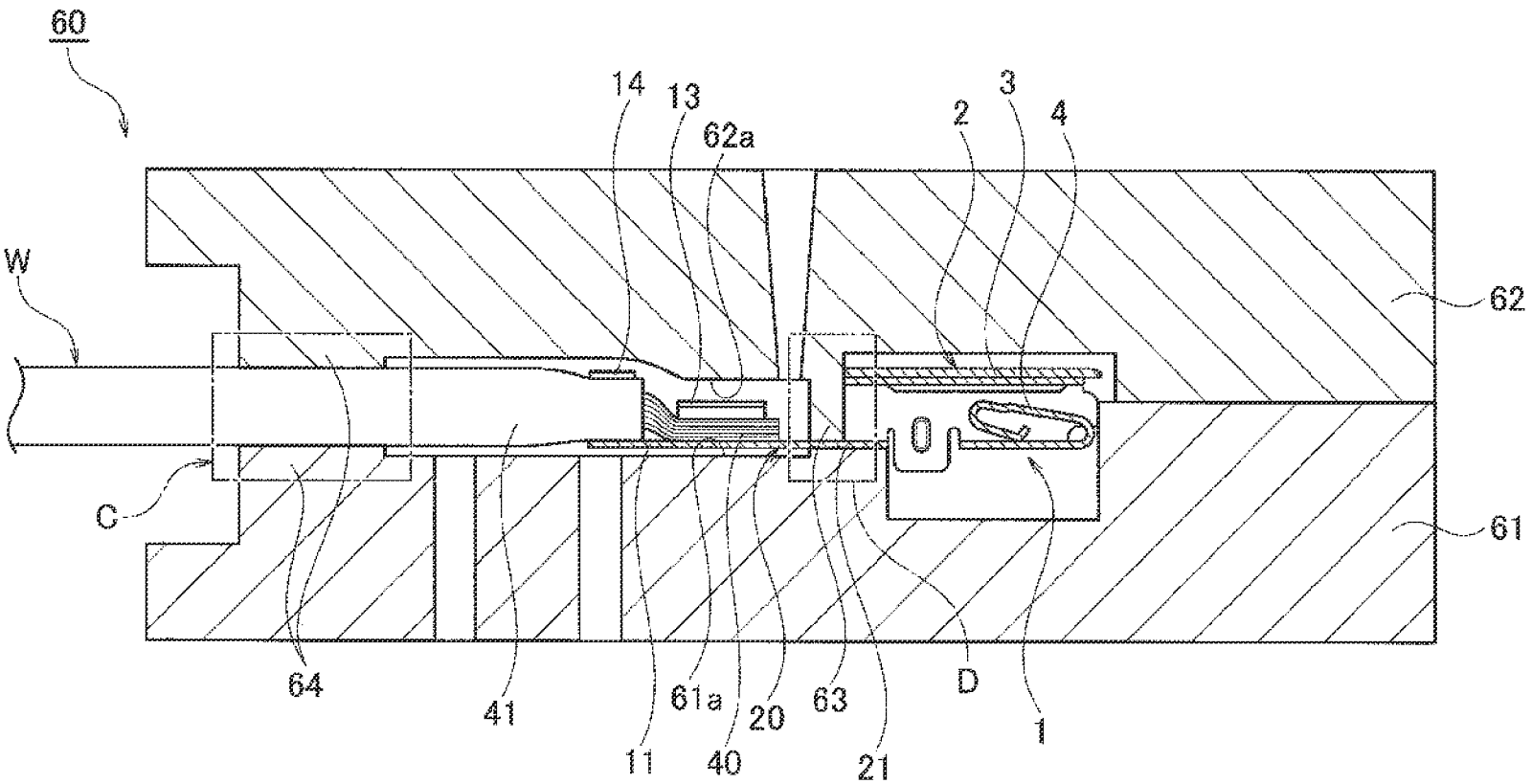
FIG. 10 is a sectional view along an X-X line in FIG. 9.

When the resin covering portion 30 is molded, as shown in FIG. 10, the wire W and the connection terminal 1 are held in proper positions by the wire holding portion 64 and the resin blocking piece 63 serving also as a terminal holding portion respectively; therefore, bending deformation (bend up) of the connection terminal 1 can be limited as much as possible. The resin blocking piece 63 also serves as a terminal holding portion; therefore, the configuration can be made simpler.

During wire connection in which the wire W is crimp-connected to the wire connection portion 10, as shown in FIGS. 7A and 7B, the pair of parallel wall portions 22*a* of the neck portion 20 are corrected to proper positions by the neck portion correction portion 51; therefore, in the resin molding process as a subsequent process, as shown in FIG. 13, the resin blocking piece 63 can be arranged inside the pair of parallel wall portions 22*a* reliably without any gap.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connection terminal comprising:

a terminal connection portion to be connected with a partner terminal;

a wire connection portion connected with a wire;

a neck portion connecting the terminal connection portion and the wire connection portion and having a bottom wall and a pair of side walls installed upright from both sides of the bottom wall, the pair of side walls having parallel wall portions equally spaced from each other and inclined wall portions inclined in directions that gradually make the interval narrower from the terminal connection portion toward the wire connection portion; and a resin covering portion covering a connection portion of the wire connection portion and the wire and molded by resin injection molding by use of a die, wherein a resin blocking piece of the die placed in between the parallel wall portions of the pair of side walls blocks a resin poured into the die in molding of the resin covering portion, and wherein the pair of side walls are formed continuously from walls of the terminal connection portion to walls of the wire connection portion.

2. The connection terminal according to claim 1, wherein a length of the parallel wall portions is larger than a width of the resin blocking piece.

3. A method of manufacturing a connection terminal comprising:

producing a terminal connection portion to be connected with a partner terminal, a wire connection portion connected with a wire, and a neck portion connecting the terminal connection portion and the wire connection portion and having a bottom wall and a pair of side walls installed upright from both sides of the bottom wall;

connecting the wire connection portion and the wire such that the pair of side walls of the neck portion have parallel wall portions equally spaced from each other and inclined wall portions inclined in directions that gradually make the interval narrower from the terminal connection portion toward the wire connection portion, the pair of side walls extending continuously from walls of the terminal connection portion to walls of the wire connection portion;

covering a connection portion of the wire connection portion and the wire with a die;

placing a resin blocking piece of the die in between the parallel wall portions of the pair of side walls;

pouring a resin into the die;

blocking the poured resin with the resin blocking piece; and molding a resin covering portion by resin injection molding.

4. The method of manufacturing a connection terminal according to claim 3, wherein when the resin covering portion is molded, the wire and the neck portion are each held in proper positions by holding portions of the die.

5. The method of manufacturing a connection terminal according to claim 3, wherein when the wire connection portion and the wire are connected, the parallel wall portions of the neck portion are corrected to a proper position by a neck portion correction portion of the die.

6. The method of manufacturing a connection terminal according to claim 3, wherein a length of the parallel wall portions is formed larger than a width of the resin blocking piece.

7. A method of manufacturing a connection terminal comprising:

producing a terminal connection portion to be connected with a partner terminal, a wire connection portion connected with a wire, and a neck portion connecting the terminal connection portion and the wire connection portion and having a bottom wall and a pair of side walls installed upright from both sides of the bottom wall;

connecting the wire connection portion and the wire such that the pair of side walls of the neck portion have parallel wall portions equally spaced from each other;

covering a connection portion of the wire connection portion and the wire with a die;

placing a resin blocking piece of the die in between the parallel wall portions of the pair of side walls;

pouring a resin into the die;

blocking the poured resin with the resin blocking piece; and molding a resin covering portion by resin injection molding, wherein when the wire connection portion and the wire are connected, the parallel wall portions of the neck portion are corrected to a proper position by a neck portion correction portion of the die.

* * * * *